United States Patent [19]

Bornwasser et al.

[11] Patent Number: 4,742,917

[45] Date of Patent: May 10, 1988

[54] MULTIPLE PACKAGING ARRANGEMENT

[75] Inventors: Hans-Joachim W. Bornwasser, Bergneustadt; Ulrich R. Loss, Marienheide; Gernot Handke, Gummersbach, all of Fed. Rep. of Germany

[73] Assignee: Square D Company, Palatine, Ill.

[21] Appl. No.: 908,769

[22] Filed: Sep. 18, 1986

[51] Int. Cl.[4] ..... B65D 43/16; B65D 5/54

[52] U.S. Cl. ..... 206/602; 206/611; 206/626; 229/120.03; 229/125.19

[58] Field of Search ..... 206/602, 608, 611, 631, 206/622, 626; 229/15, 43, 152; 220/23.4

[56] References Cited

U.S. PATENT DOCUMENTS

| | | | |
|---|---|---|---|
| 134,394 | 12/1872 | Osborne | 229/152 |
| 2,205,437 | 6/1940 | Ringler | 206/631 |
| 4,335,844 | 6/1982 | Egli | 206/626 |
| 4,487,319 | 12/1984 | Barrash | 206/602 |
| 4,533,052 | 8/1985 | Fruchey et al. | 206/602 |

FOREIGN PATENT DOCUMENTS

| | | | |
|---|---|---|---|
| 240404 | 8/1962 | Australia | 206/611 |
| 2806308 | 8/1978 | Fed. Rep. of Germany | 206/626 |
| 2444624 | 8/1980 | France | 220/23.4 |
| 610682 | 10/1960 | Italy | 206/602 |
| 382645 | 9/1964 | Switzerland | 206/602 |
| 1454527 | 11/1976 | United Kingdom | 206/602 |

*Primary Examiner*—Stephen Marcus
*Assistant Examiner*—Gary E. Elkins
*Attorney, Agent, or Firm*—Steve A. Litchfield; Thomas B. Lingdren; Richard T. Guttman

[57] ABSTRACT

This disclosure depicts a novel apparatus for packaging components in a multiple type packaging arrangement which permits the multiply packaged components to either be opened as an entire unit or individually. In particular, this packaging arrangement comprises a plurality of aligned, open ended boxes having disposed over the open ends a U-shaped sheet, the sheet having a middle flat plane and two planes depending therefrom at right angles thereto, the middle plane sealing the open ends of the boxes. The U-shaped sheet dimensioned such that it will overlap the plurality of aligned open ended boxes and the U-shaped sheet having score marks therein corresponding with the ends of the individual boxes permitting individual boxes or groups thereof to be broken away from the plurality. The U-shaped sheet also having a frangible strip by which the open area of the boxes may be exposed either individually or as a group by tearing the frangible strip, thereby allowing the flat plane of the U-shaped sheet to pivot and expose the open ends of the boxes.

12 Claims, 3 Drawing Sheets

18

MULTIPLE PACKAGING ARRANGEMENT

BACKGROUND OF THE INVENTION

This invention relates in general to the packaging of materials for transport and sale and in particular, relates to packaging individual components in a multiple-type package for storage, and sale.

Traditional packaging of the cardboard type in a multiple of multi-pack form has usually comprised a separate standard cardboard box having flaps at both ends and holding individual cartons inside. This type of multiple packaging generally required hand packaging. Once some of the individual boxes inside the large carton were removed the others generally would not remain stacked inside, but would be free to move about if the package were jostled or otherwise disturbed. Also, this type of packaging is expensive since a single large carton is used to contain many smaller cartons. Also, when desiring to use the packaged components, each individual carton must be opened which requires additional labor and cost. To avoid the expense and labor associated with this traditional type packaging, other types of multiple packaging arrangements have been employed. These have comprised a sealing strap of plastic or a shrink wrap type material used to bind individual cartons together. Packaging in this manner did not facilitate the easy removal of one unit without breaking open and disturbing the entire pack. Once the entire pack was broken open, other individual units could easily become dislodged or lost from the pack. Also, neither the traditional packaging nor the other types of packaging provides a means by which the individual components could be readily placed in the packaging and sealed with a minimum number of steps in the manufacturing process.

Thus, there is a need in the field for a multiple packaging arrangement which allows for the easy insertion of products into the packaging during the packaging process, and allows for the multiply packaged components to be maintained in a uniform, single pack. Also, there is a need in the field for a multi-pack-type unitary packaging which will allow an entire group of packaged components to be removed from the packaging at once without individually opening each individual box. Further, there is a need for a multi-pack packaging arrangement which will allow either individually packaged components or the components themselves to be removed from the packaging without affecting the structural means by which the multiply packaged components are maintained as a single unit.

SUMMARY OF THE INVENTION

It is a general object of the present invention to provide for a multi-pack-type packaging arrangement in which individual components may be maintained in a single, unitary pack and in which individual packages may be removed from the back without disturbing the structural integrity of the entire multi-pack. It is an additional object of the present invention to provide an effective means by which individual components may be packaged in top individual boxes and then strucured into a multi-pack type arrangement through a minimum of of manufacturing steps for both ease of packaging and reduction in the cost of manufacture. It is another object of the present invention to provide a means by which all of the units packaged in the multi-pack packaging may be quickly and easily removed without individually opening each package. It is an additional object of the present invention to provide means by which individual components may be selectively removed from the multi-pack arrangement without disturbing the structural integrity of the multi-pack.

The objects of the present invention are met by providing a traditional cardboard box sealed at one end in the conventional manner and open at its opposite end having the open end sealed with a U-shaped sheet. A plurality of these boxes are arranged in a line. These boxes then have placed therein the components that are to be packed therein. A single, elongate U-shaped cardboard member is placed over the open ends of the aligned box. Said U-shaped cardboard member has three flat sides all joined at right angles to each other. The middle flat side corresponds in shape and dimension to the width of the open areas of the boxes. The U-shaped member is adhesively sealed over the arrangement of boxes such that a unitary pack is formed having the U-shaped member providing the structural integrity to hold all of the boxes together. The U-shaped member is scored along lines consistent with the end lines of each individual box such that each individual box may be broken away from the rest of the pack along the score lines. Since each box is individually sealed to the U-shaped member along its sides, the individual packaging component that is broken away from the remaining pack forms a complete sealed package in itself.

The U-shaped member has a frangible strip thereon permitting the open ends of the boxes to be exposed by removing the strip and separating the middle section of the U-shaped member from the sealed flap on one side. In this manner, the entire contents of the multiple packaging arrangement can be unpackaged by tearing the frangible strip along all of the boxes.

Since the opposite end of the box is closed in the conventional manner and is not covered by the U-shaped strip, it may be opened and reclosed to remove or reinsert the product as with, a traditional cardboard box.

By providing an arrangement of the above description, it is seen that the aligned open ended boxes may easily have products inserted therein and a single U-shaped strip placed thereover and adhesively sealed to the boxes to form a total, single, sealed enclosure. This forms a complete unitary pack of multiple units which may be easily opened through the frangible strip or may be broken away in individual packages from the rest of the multi-pack without disturbing the structural integrity of the entire pack. This provides a large degree of flexibility in the use of components, especially of types that are normally bought in large quantities and used selectively such as by contractors on job sites.

Further objects and advantages of the invention will become apparent as the following description proceeds. The features of novelty which characterize the invention will be pointed out with particularity in the claims annexed to and forming a part of the specification.

DESCRIPTION OF THE DRAWINGS

The features of the present invention which are believed to be novel are set forth with particularity in the appended claims. The invention together with further objects and advantages thereof may best be understood by reference to the following description taken in conjunction with the accompanying drawings in the several figures of which like reference numerals identify like elements and in which:

DETAILED DESCRIPTION

Figure 1:
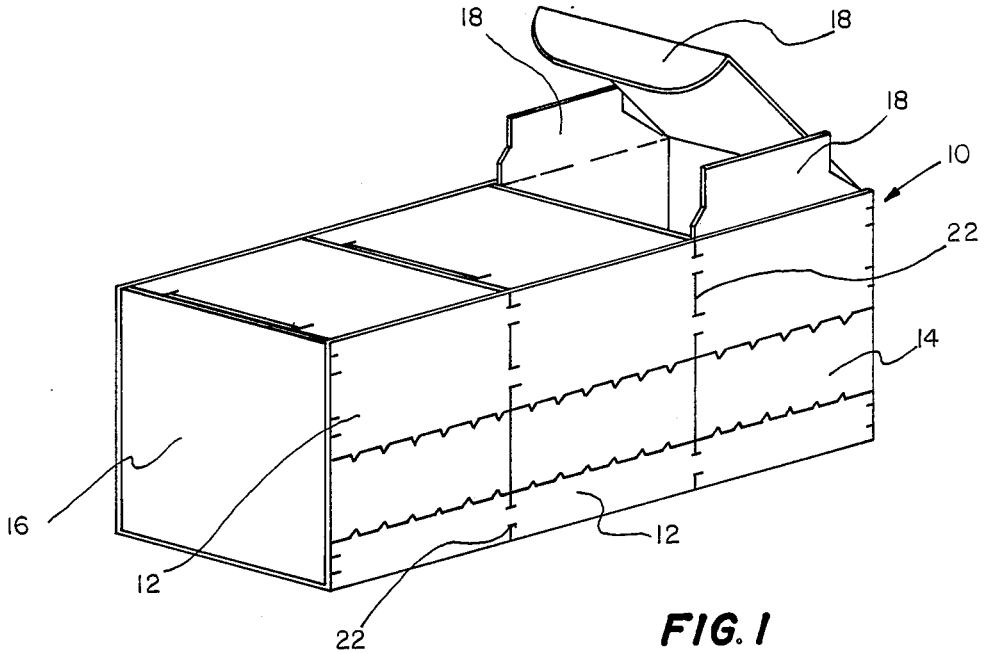
FIG. 1 is a top perspective view of the assembled packaging of the present invention showing a three pack multiple package arrangement having one of the individual packages open at the conventional end.

The novel apparatus for the multiple unit packaging of the present invention is shown generally in FIG. 1 as element 10. In the drawings the packaging shows three individual boxes 16 packaged in the manner to be described. It is important to point out that the concept of the present invention encompasses any number of individual boxes packaged together. Using the present invention with small type electrical products such as electrical push button switches a multiple pack of ten individual boxes would be desirable.

FIG. 1 illustrates packaging 10 having U-shaped member 12 shown secured thereto. U-shaped member 12 surrounds two sides and one end of the individual boxes 16 in the position shown in FIG. 1. The U-shaped member 12 has frangible strip 14 running therealong which when removed will serve to expose the open ends of boxes 16. Individual boxes 16 are held together in a unitary pack by the U-shaped member 12. FIG. 1 also shows that the single boxes 16 have conventional open end flaps 18 allowing the removal of individual components packaged therein without breaking the multiple packaging unit 10.

Figure 2:
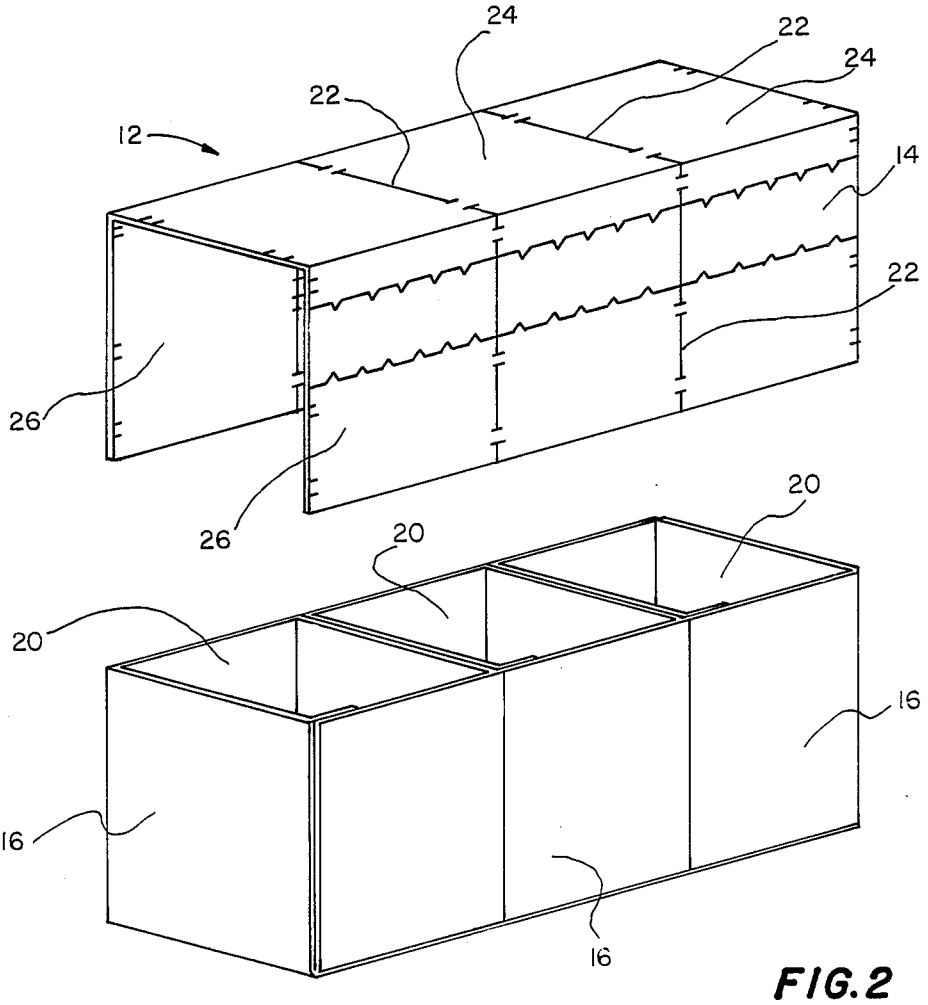
FIG. 2 is a top perspective view of a section of packaging arrangement showing the open, individual boxes having a U-shaped sealing member disposed thereover.

FIG. 2 illustrates in more detail the arrangement of the U-shaped member 12 with respect to the individual boxes 16. FIG. 2 shows a plurality of three boxes 16 arranged side by side each box 16 having open end 20 opposite to the conventional ends 18, as shown in FIG. 1. U-shaped member 12 is ready for placement over the aligned, single boxes 16. Once placed over the open ends 20 of single boxes 16, the end sections 26 of U-shaped member 12 are adhesively secured to the corresponding sides of each individual box 16 by a suitable adhesive element, such as glue. U-shaped member 12 is shown in FIG. 2 as having mid-section 24 in the same dimension as open end 20 of box 16 to correspond thereto and cover said open end 20. Score lines 22 mark the respective dimensions along U-shaped member 12 that correspond with the individual ends of boxes 16 when aligned as shown in FIG. 2.

Figure 3:
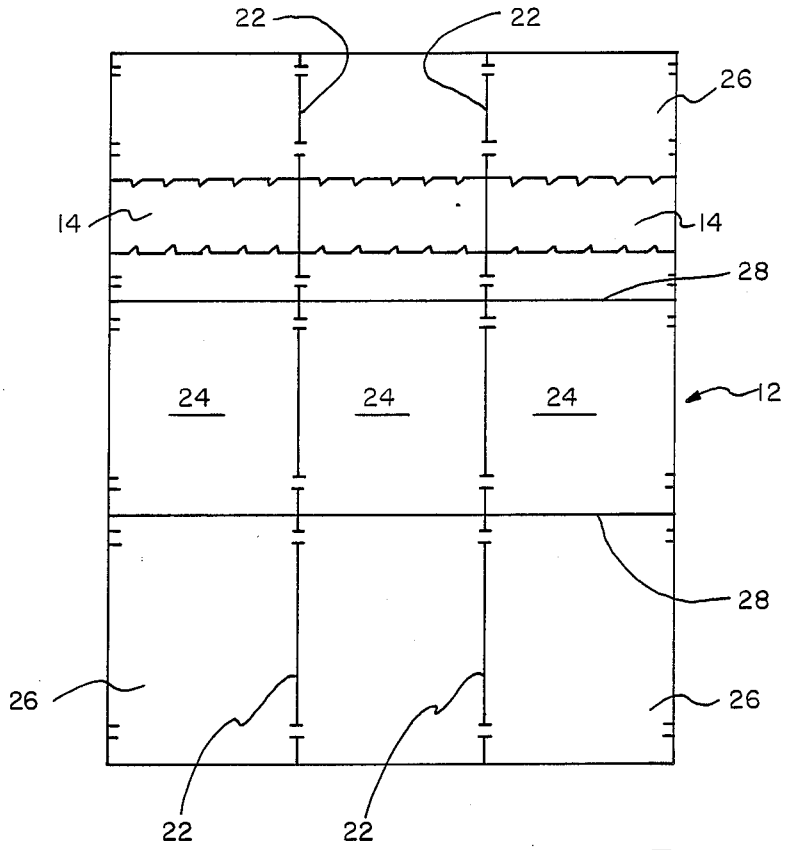
FIG. 3 is a top plan view of the U-shaped member showing the score lines and fold lines and the frangible strip.

U-shaped member 12 is shown in top plan view of FIG. 3. In FIG. 3 it is seen that U-shaped member 12 is in the form of a rectangle and has fold lines 28 delineating the mid-section 24 which corresponds to the open end 20 of box 16. End sections 26 project from mid-section 24 with one end section 26 having the frangible strip 14 scored therein. Score lines 22 run perpendicular to fold lines 28 and are spaced at intervals corresponding to the width of boxes 16 when aligned for receiving the U-shaped member 12 is in the packaging process.

In packaging the individual components in the boxes 16, the boxes 16 are arranged as shown in FIG. 2. The components to be packaged are then inserted either by machine or by hand, and the U-shaped member 12 is then placed over the entire alignment of boxes 16 thereby covering each of the open ends 20. End sections 26 of U-shaped member 12 are adhesively secured to the sides of each box 16, thereby sealing the packaging 10.

Figure 4:
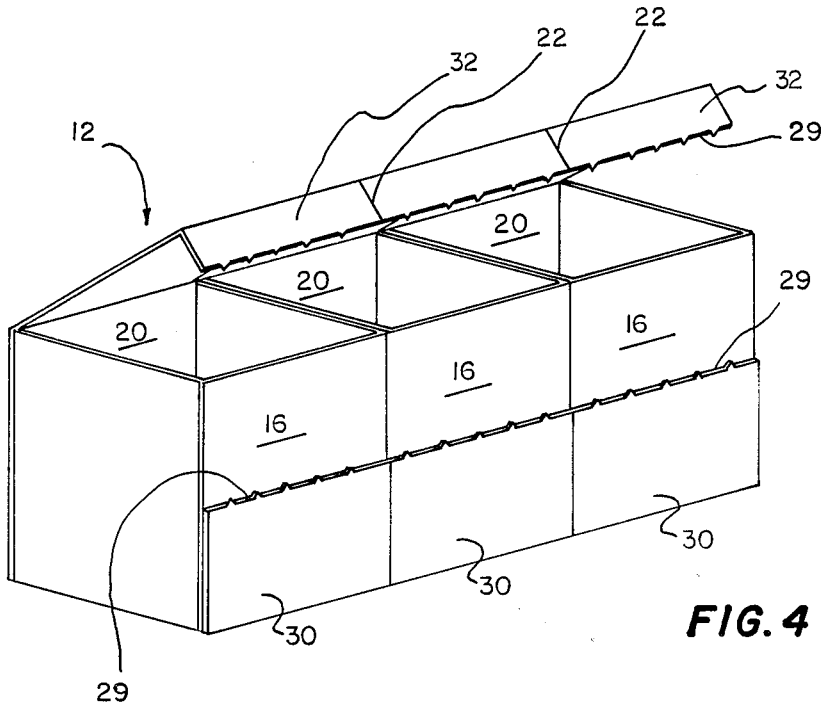
FIG. 4 is a top perspective view of a section of multiple packaging having the frangible strip removed and thereby exposing the open ends of the individual boxes.

If it is desired to remove all of the elements packaged in the unitary packaging 10 at once, the frangible strap 14 is torn from the assembled packaging 10 as shown in FIG. 4. FIG. 4 illustrates the opening of the packaging after the strip 14 is removed. Removal of strip 14 leaves the remaining section 30 shown in FIG. 4 which has been adhesively secured to the individual boxes 16. Rough edges 29 are formed on the remaining end 30 and the remaining end of what is now flap 32 formed after removal of frangible strip 14. Removal of strip 14 exposes open ends 20 of boxes 16. By removing strip 14 from the packaging 10 or a section thereof, the components packaged in boxes 16 may be quickly and easily removed. The packaging may then be resealed by tearing along score lines 22 on flap 32 to allow insertion of the now individual flaps 32 into the open ends 20 of boxes 16. However, if it is desired to reuse the packaging, the preferred method of removing individual components from the unitary pack would be to open conventional flap ends 18 as shown in FIG. 1.

Figure 5:
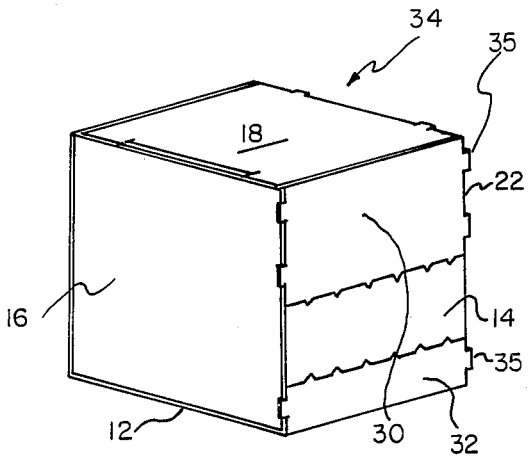
FIG. 5 is a top perspective view of an individual, sealed box after it has been broken away from the multipack.
Figure 6:
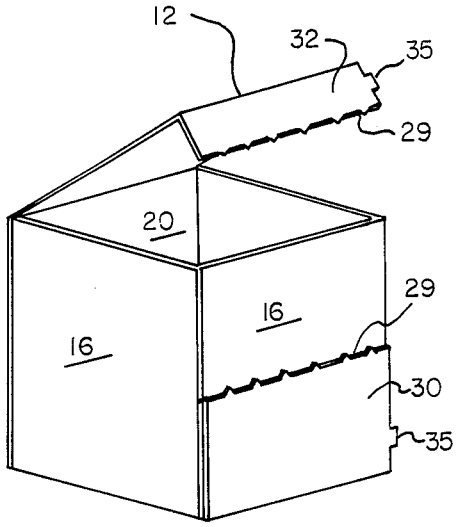
FIG. 6 is a top perspective view of the individual, sealed box having the frangible strip removed.
Figure 7:
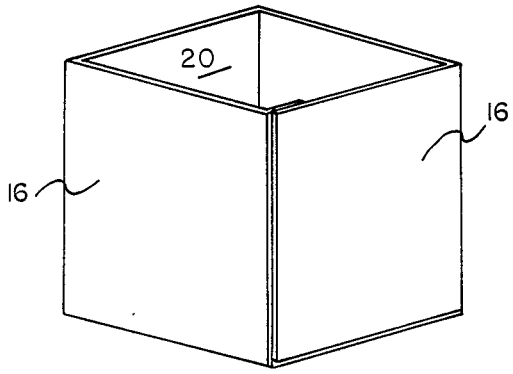
FIG. 7 is a top perspective view of the individual box prior to having the U-shaped member placed thereover and prior to it being assembled in a line with other boxes as shown in FIG. 2.
Figure 9:
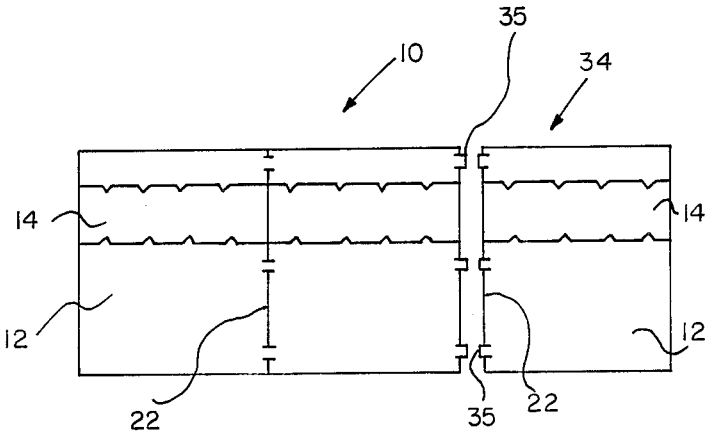
FIG. 9 is a side view of the packaging arrangement having one of the individual packages broken from the remaining pack.

In the packaging 10 shown in FIG. 1, score lines 22 permit individual units to be broken away from the overall pack. This is better illustrated in FIG. 9 in which the pack 10 has individual, sealed unit 34 broken at tear points 35 along score lines 22. The individual package 34 as shown in FIG. 5 comprises a complete sealed unit. U-shaped member 12 covers the open end 20 of box 16 and seals the open end 20 such that the component therein is completely packaged. The single package 34 may be opened by tearing frangible strip 14 to expose open end 20 as shown in FIG. 6. This forms flap 32 with rough end 29. Remaining section 30 of U-shaped member 12 is left adhered to the side of box 16. Another method of opening the single package 34 would be to open conventional flaps 18 as shown in FIG. 1. Tear points 35 are shown both in FIGS. 5 and 6 illustrating the tearing of the U-shaped member 12 along score lines 22.

Figure 8:
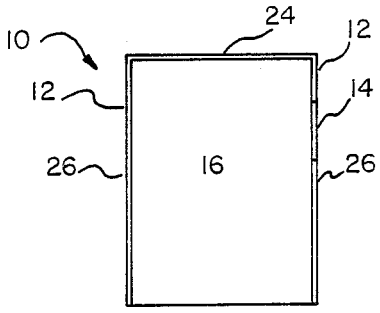
FIG. 8 is a side view of the packaging arrangement with the U-shaped member sealed therearound.
Figure 10:
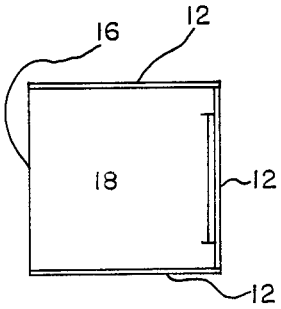
FIG. 10 is a bottom view of an individual box showing the U-shaped member disposed therearound.

FIGS. 8 and 10 illustrate the side and bottom view of the assembled packaging 10 having U-shaped member 12 disposed over box 16 and adhered thereto. It should be noted that the end 18 of box 16 is hot covered by U-shaped member 12 and is thus left opened for access to the interior of the box in the conventional manner. Mid-section 24 forms a close fit over open end 20 of box 16, with end sections 26 adhered to the sides of box 16.

In the preferred mode the adhesive would be applied beneath the frangible strip 14 on end sections 26 and corresponding sides of box 16 to adhere the U-shaped member 12 to box 16. By so placing the adhesive, frangible strip 14, when removed, will allow the upper section of U-shaped member 12 to form the flap arrangement 32 shown in FIGS. 4 and 6. FIG. 10 illustrates the bottom view of packaging 10 showing that the U-shaped member 12 is adjacent opposite sides of box 16 and again leaves conventional end 18 of box 16 accessible for use to insert or remove the packaged item.

The above description illustrates a novel packaging assembly for permitting easy insertion of the packaged items and to the opened ends 20 of the individual boxes 16. A single, elongate U-shaped member 12 is used to seal and structurally support the entire multi-pack assembly. The assembly shown in the drawings consists of only three units, however, any number of units could comprise the multi-pack assembly. The present arrangement allows the entire assembly to be purchased as a unit or in individual components by breaking off an individually packaged unit along score lines 22. Frangible strip 14 permits quick and easy access to the packaged components, and the fact that conventional end 18 of box 16 is left open allows for the material to be accessible in the conventional manner. This is desirable if the package 10 is to be reused. Further, the present invention as above disclosed allows for removal of individual packaged units from the multistrip packaging without interfering with the structural integrity of the remaining packaging. Thus, a ten unit pack can have any number of units removed without disturbing the packaging of the remaining units and their relationship to one another. In the preferred mode, the material of which the packaging is formed, is intended to be standard cardboard as used in most other packaging, however, other materials may be used to practice the invention depending on the intended use of the packaging and the components packaged therein. Thus, the invention is not limited to the particular details of construction of the device depicted and other modifications and applications are contemplated. For example, different means for providing a frangible strip 14 rather than a preformed score line, as shown herein, could be used so long as the differing means allowed the top section of U-shaped member 12 to be separated from the section adhered to the sides of boxes 16. Certain other changes may be made in the above described invention without departing from the true spirit and scope of the invention herein involved. It is intended therefore that the subject matter in the above depiction shall be interpreted as illustrative and not in a limiting sense.

We claim:

1. An arrangement for the multiple packaging of components comprising a plurality of individual boxes, each said box having four sides and two ends, one of said ends having a pivotal flap formed therein for sealing said end and the other end comprising an open area communicating with the interior of each said box and opposite said end with said pivotal flap; each said individual box arranged such that said open ends are on a common side and each box having at least one of said sides adjacent another side of another box such that the boxes form a singular array; a U-shaped member having a middle section corresponding in shape to the open areas of the aligned boxes and two end sections projecting from the middle section on opposite sides thereof and at right angles thereto such that the end sections overlap opposite sides of the boxes and the middle section is adjacent and over and open area of each said box, and means for adhering the end sections of the U-shaped member to the sides of the boxes, said U-shaped member having individual score lines formed therein and corresponding with the sides of the individual boxes such that once said U-shaped member is adhered to the boxes, individual boxes or groups of boxes may be broken away from the remaining box or group of boxes by breaking the U-shaped member at the score lines.

2. The arrangement of claim 1 where the means for adhering the end sections to the sides of the boxes comprises a glue.

3. The arrangement of claim 1 where the individual boxes and U-shaped member are comprised of cardboard.

4. The arrangement of claim 1 where the U-shaped member includes a frangible strip formed therein along an end section thereof whereby removal of the frangible strip from the U-shaped member when said member is adhered to the boxes permits the middle section of the U-shaped member to pivot with respect to the open area of said box to expose said open area.

5. The arrangement of claim 1 where the U-shaped member has parallel fold lines formed therein to define the middle section of said member.

6. A packaging arrangement for uniformly sealing a plurality of aligned individual boxes to form a single multiple packing array, where each said box has an open end and a closed end, said arrangement comprising a rectangular sheet having a middle section and two end sections projecting at opposite ends therefrom, said middle section defined by a pair of parallel fold lines formed therein, such that said sheet when folded about said fold lines, to right angles to the middle section, forms a substantially U-shaped member with said middle section forming a plane corresponding in dimension to the dimension of the aligned open ends of said boxes; said rectangular sheet having formed therein means for separating the rectangular sheet at predetermined sections, each said section corresponding in dimension to the dimension of an individual box in the packaging array; whereby the U-shaped member may be placed over the open ends of the plurality of boxes and adhered thereto to seal the open ends of the boxes and form a sealed package structurally supporting and sealing the individual boxes.

7. The arrangement of claim 6 where the separating means comprises a series of parallel lines scored into the material of the rectangular sheet such that upon exerting a tensile force at selective locations on the rectangular sheet it will tear at and along the individual score lines.

8. The arrangement of claim 6 where the rectangular sheet has means for exposing the open area of the individual boxes formed thereon such that when operated said means allows a portion of the rectangular sheet to open permitting access to the interior of said boxes.

9. The arrangement of claim 8 where the means for exposing the interior of the individual boxes comprises a frangible strip scored in the rectangular sheet parallel to one of the fold lines and substantially adjacent thereto such that removing te frangible strip causes a flap to be formed by the middle section where said flap is pivotal with respect to the open end of the individual box to expose said open end for access to the interior of said box.

10. The arrangement of claim 6 where the rectangular sheet is adhered to the individual boxes by a glue.

11. The arrangement of claim 6 where the rectangular sheet comprises cardboard.

12. The packaging arrangement of claim 6 where the closed end has a foldable flap for closing said end such that said end may be opened and closed by folding the flap with respect to the box end.

* * * * *